US007029453B2

(12) United States Patent
Chen

(10) Patent No.: US 7,029,453 B2
(45) Date of Patent: Apr. 18, 2006

(54) MASSAGING MECHANISM OF MASSAGING MACHINE

(76) Inventor: Ko-Po Chen, No. 36, 12th Rd., Ta-Li Industrial District, Ta-Li City, Taichung (TW)

( * ) Notice: Subject to any disclaimer, the term of this patent is extended or adjusted under 35 U.S.C. 154(b) by 463 days.

(21) Appl. No.: 10/618,438

(22) Filed: Jul. 9, 2003

(65) Prior Publication Data

US 2005/0010144 A1 Jan. 13, 2005

(51) Int. Cl.
*A61H 15/00* (2006.01)

(52) U.S. Cl. ..... 601/99; 601/100; 601/102; 601/116

(58) Field of Classification Search ..... 601/86, 601/87, 90, 93–95, 97, 98–103, 116, 117, 601/122, 126

See application file for complete search history.

(56) References Cited

U.S. PATENT DOCUMENTS 6,224,563 B1 * 5/2001 Nonoue et al. ..... 601/99
6,511,448 B1 * 1/2003 Furuie et al. ..... 601/98
6,629,939 B1 * 10/2003 Jikiba et al. ..... 601/99

* cited by examiner

*Primary Examiner*—Quang D. Thanh
(74) *Attorney, Agent, or Firm*—W. Wayne Liauh

(57) ABSTRACT

A massaging machine is provided with a massaging mechanism comprising a displacement device, a rubbing device, a pounding device, and an angle-adjusting device. The rubbing device and the pounding device are provided with a shaft driven by a motor. The shaft of the rubbing device is provided at two ends with a plurality of rubbing rollers. The displacement device comprises a shaft, and a worm wheel set driven by a motor to actuate the shaft which is linked with a transmission device to enable the massaging mechanism to engage in a linear motion on a machine frame of the massaging machine. As the body of a person comes in contact with the rubbing rollers, the massaging mechanism is securely located in place, thanks to the self-locking action of a worm wheel set of the displacement device.

10 Claims, 19 Drawing Sheets

MASSAGING MECHANISM OF MASSAGING MACHINE

FIELD OF THE INVENTION

The present invention relates generally to a massaging machine, and more particularly to a massaging mechanism of the massaging machine.

BACKGROUND OF THE INVENTION

As shown in FIGS. 1–8, the Taiwan Patent Number 90115937 discloses a massaging machine which comprises a base 1 having a support seat 11. The support seat 11 is used to mount thereon a rubbing device 2, a pounding device 3, and two displacement devices 4A and 4B.

The rubbing device 2 comprises a rubbing shaft 21 which is provided at two ends with a sleeve 22 which is in turn provided with a bearing housing 23 and a support arm 24. The support arm 24 is used to mount a roller 25. The shaft 21 is driven by a motor 26 in conjunction with a belted wheel set 27 and a worm wheel. The rollers 25 serve to effect a rubbing action, as illustrated in FIG. 5.

The pounding device 3 comprises a shaft 31 which is in turn provided at both ends with an eccentric sleeve 32. The eccentric sleeve 32 is connected to the support arm 24 of the rubbing device 2 by a connection rod 33. The shaft 31 is driven by a motor 34 in conjunction with a belted wheel set 35.

The displacement device 4B has a shaft 41 which is mounted on the support seat 11. The shaft 41 is provided at one end with a connection rod 42 for connecting a roller 43. The shaft 41 is provided at other end with a connection rod 44 which is pivoted with a connection rod 45. A feed nut 46 is engaged with a threaded rod 47 of a belted wheel set 48, which is driven by a motor 49. When the feed nut 46 displaces on the threaded rod 47, the shaft 41 is actuated by the two connection rods 44 and 45, thereby causing the base 1 to move back and forth. As a result, the massaging effect is brought about by the rollers 25.

As shown in FIGS. 3, 7, and 8, the displacement devices 4A and 4B are respectively driven by the motor 49, so as to enable the base 1 to be adjusted in angle at which the base 1 leans forward or backward. As a result, either the upper roller 25 or the lower roller 25 can be selectively used to engage in the massaging action.

Such a prior art massaging machine as described above is defective in design in that the connection rods are exerted on by a relatively large torsional moment at such time when the body part of a person comes in contact with the rollers, thereby resulting in interference of the displacement of the base. In addition, the angular adjustment of the base is attained by the two displacement devices and is therefore limited, due to the fact that the connection rods can be caused to swivel to a limited extent.

SUMMARY OF THE INVENTION

The primary objective of the present invention is to provide a massaging machine with a massaging mechanism which is free of the deficiencies of the prior art massaging mechanism described above.

In keeping with the principle of the present invention, the foregoing objective of the present invention is attained by a massaging mechanism comprising a displacement device, a rubbing device, a pounding device, and an angle-adjusting device. The rubbing device and the pounding device are respectively driven by a motor and are provided with a shaft. The shaft of the rubbing device is provided at both ends with a massaging roller. The displacement device comprises a driving source which is provided with a worm wheel set for driving a shaft of the displacement device. The shaft of the displacement device is linked with a transmission device by which the massaging mechanism is capable of a linear motion on the machine frame. As the body of a person comes in contact with the massaging rollers, the worm wheel set is exerted on by the body weight of the person so as to locate securely the massaging mechanism.

The massaging rollers in action can be adjusted angularly, due to the fact that the angle-adjusting device comprises a gear which is engaged with an arcuate rack of the pounding device. The angular adjustment of the massaging mechanism is various, depending on the curvature of the arcuate rack. In another words, the massaging mechanism of the present invention can be adjusted to fit the body curve of a person. In addition, the angular adjustment of the massaging mechanism of the present invention can be achieved by only one arcuate rack and one gear.

The rubbing device comprises a shaft having two ends, each being slanted for mounting a swing arm on which a rubbing roller is mounted.

The features and the advantages of the present invention will be more readily understood upon a thoughtful deliberation of the following detailed description of the present invention with reference to the accompanying drawings.

DETAILED DESCRIPTION OF THE INVENTION

Figure 1:
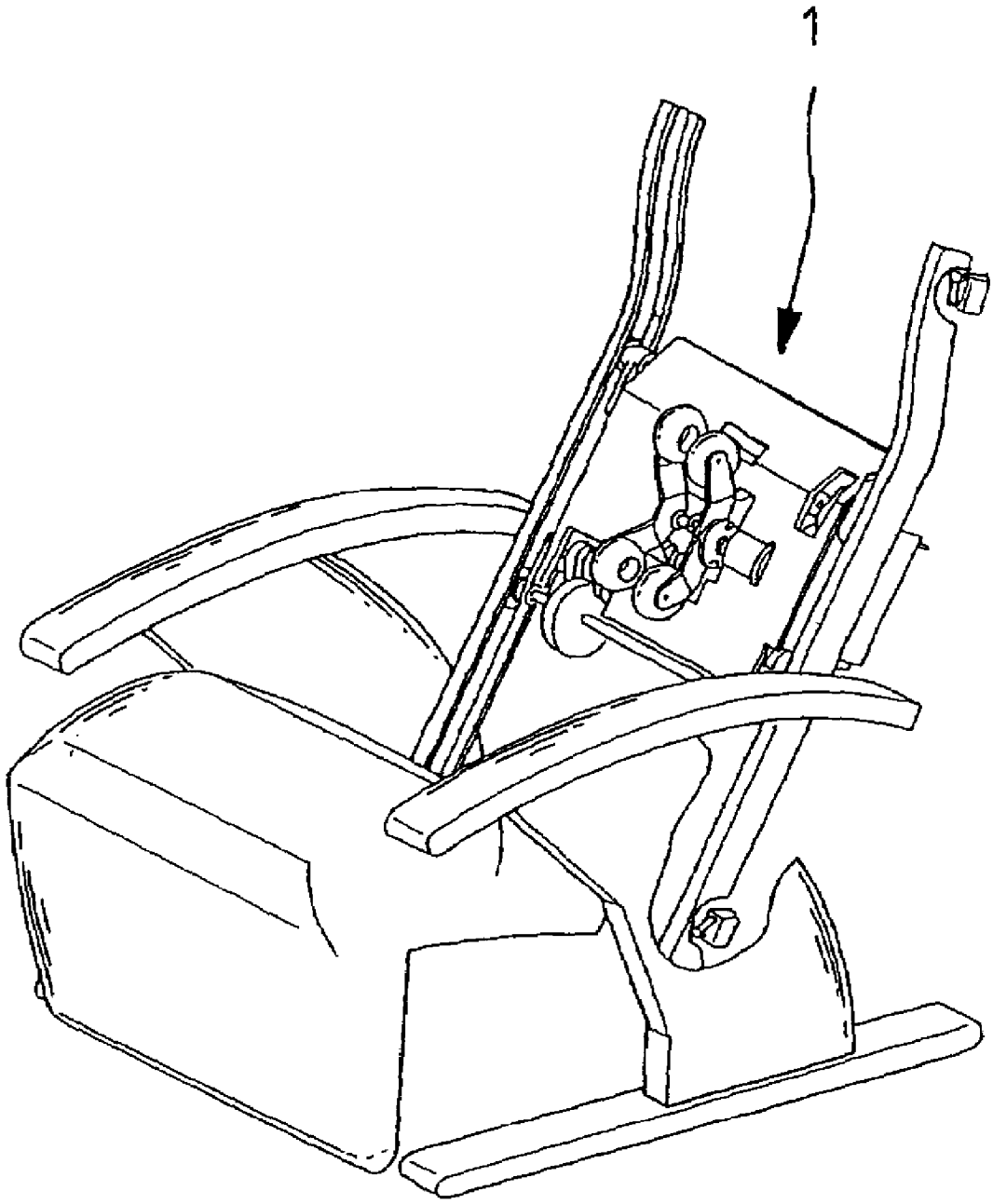
F I G . 1 PRIOR ART
FIG. 1 shows a schematic view of a prior art massaging mechanism.
Figure 2:
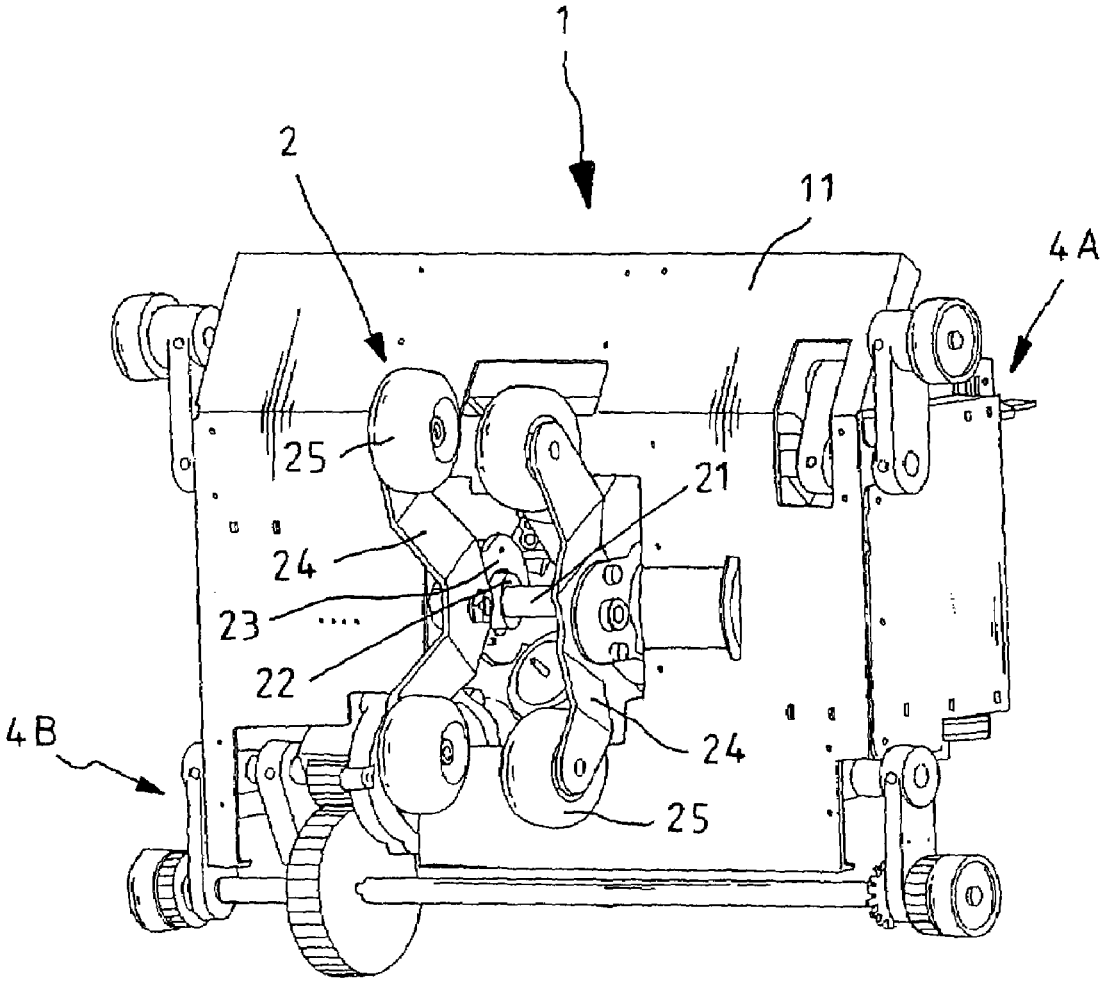
F I G . 2 PRIOR ART
FIG. 2 shows a front view of the prior art massaging mechanism.
Figure 3:
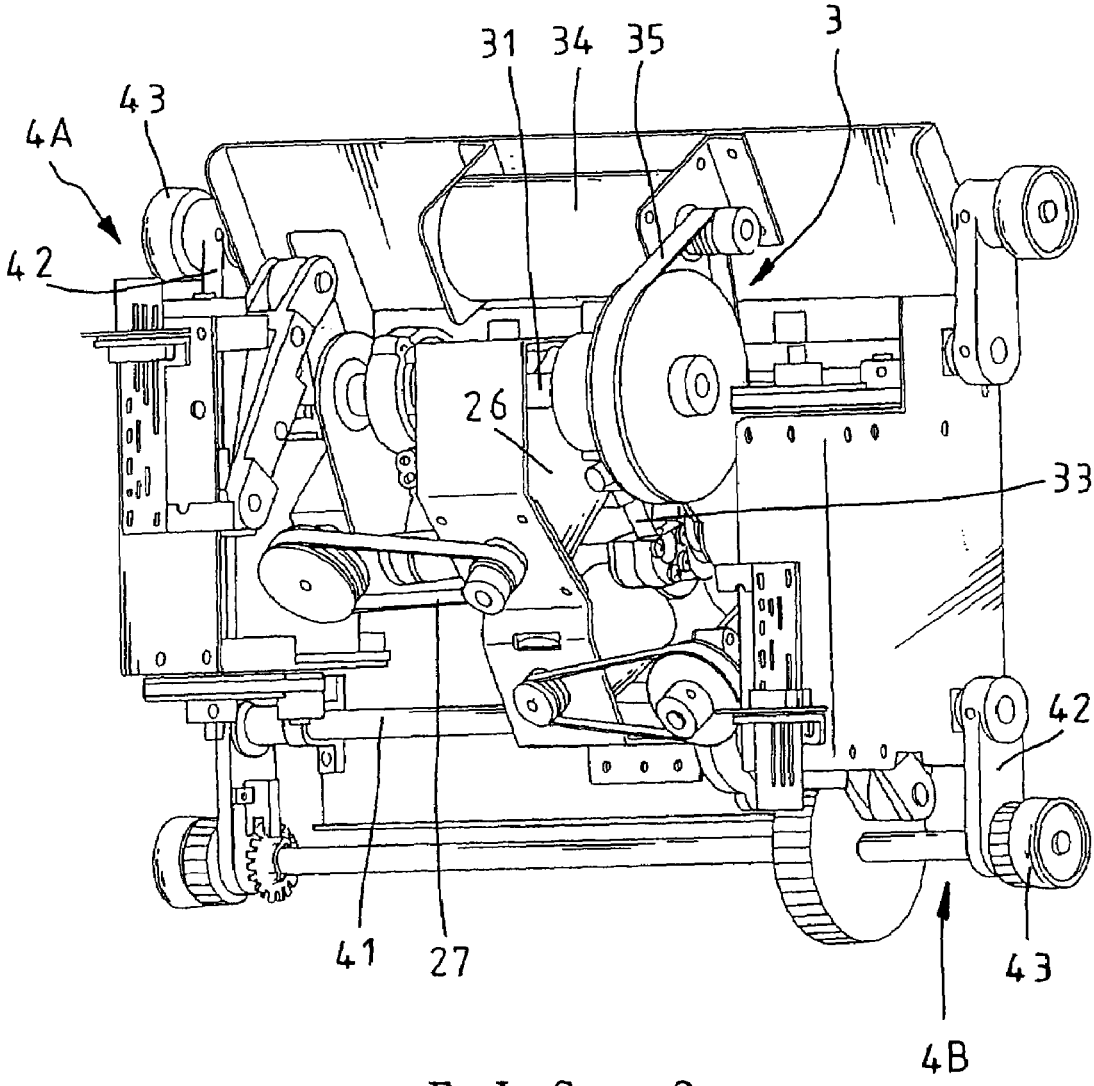
F I G . 3 PRIOR ART
FIG. 3 shows a rear view of the prior art massaging mechanism.
Figure 4:
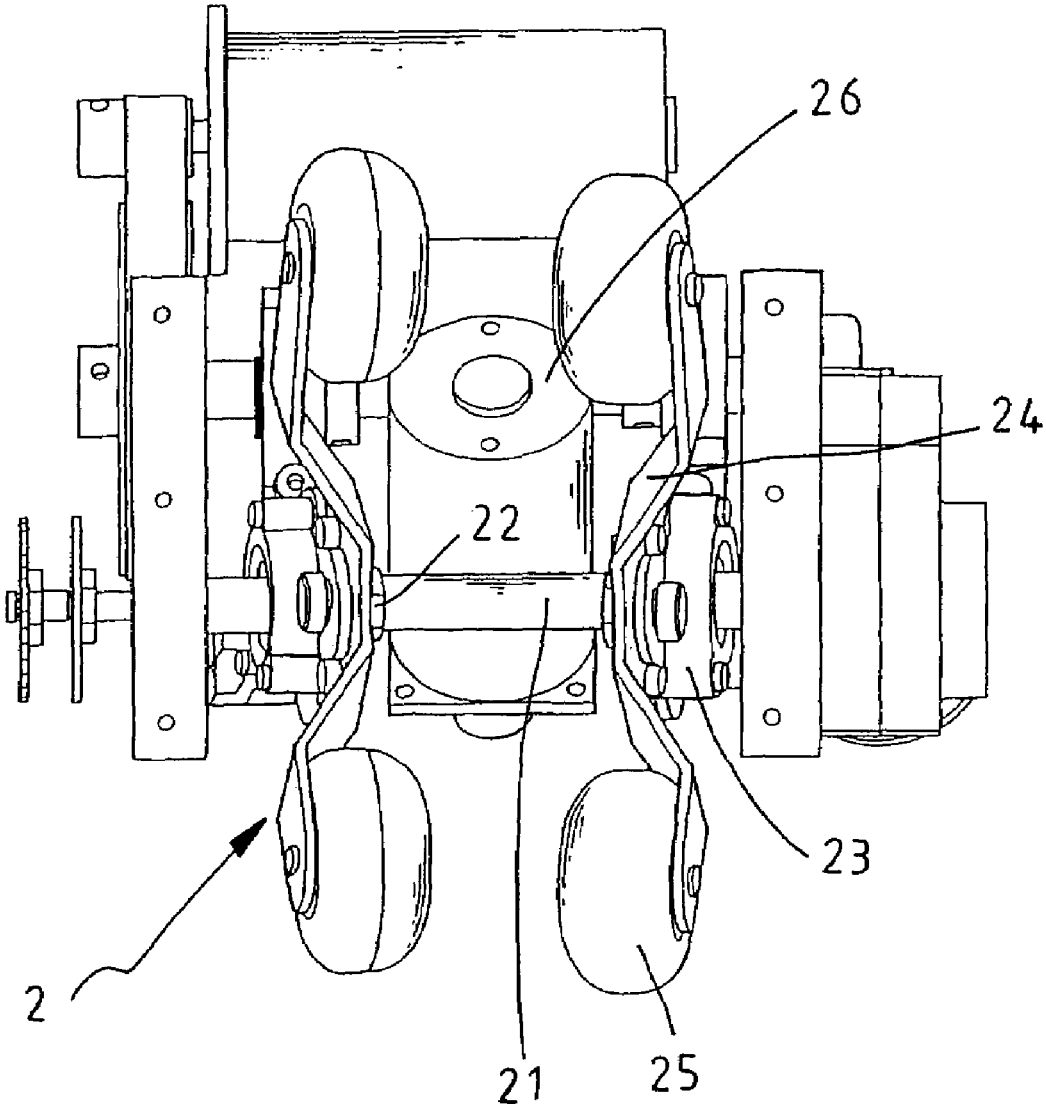
F I G . 4 PRIOR ART
FIG. 4 shows a schematic view of the rubbing device of the prior art massaging mechanism.
Figure 5:
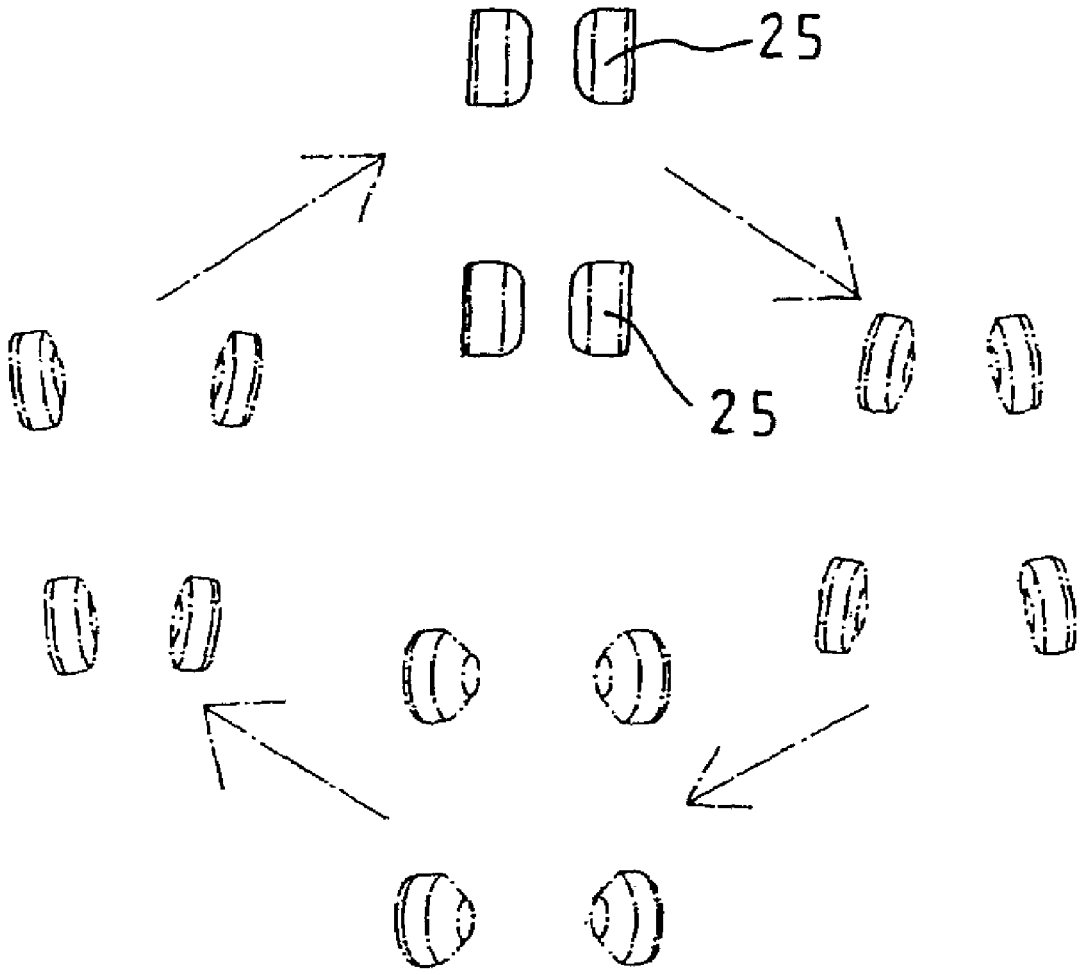
F I G . 5 PRIOR ART
FIG. 5 shows a schematic view of the rubbing rollers of the prior art massaging mechanism in motion.
Figure 6:
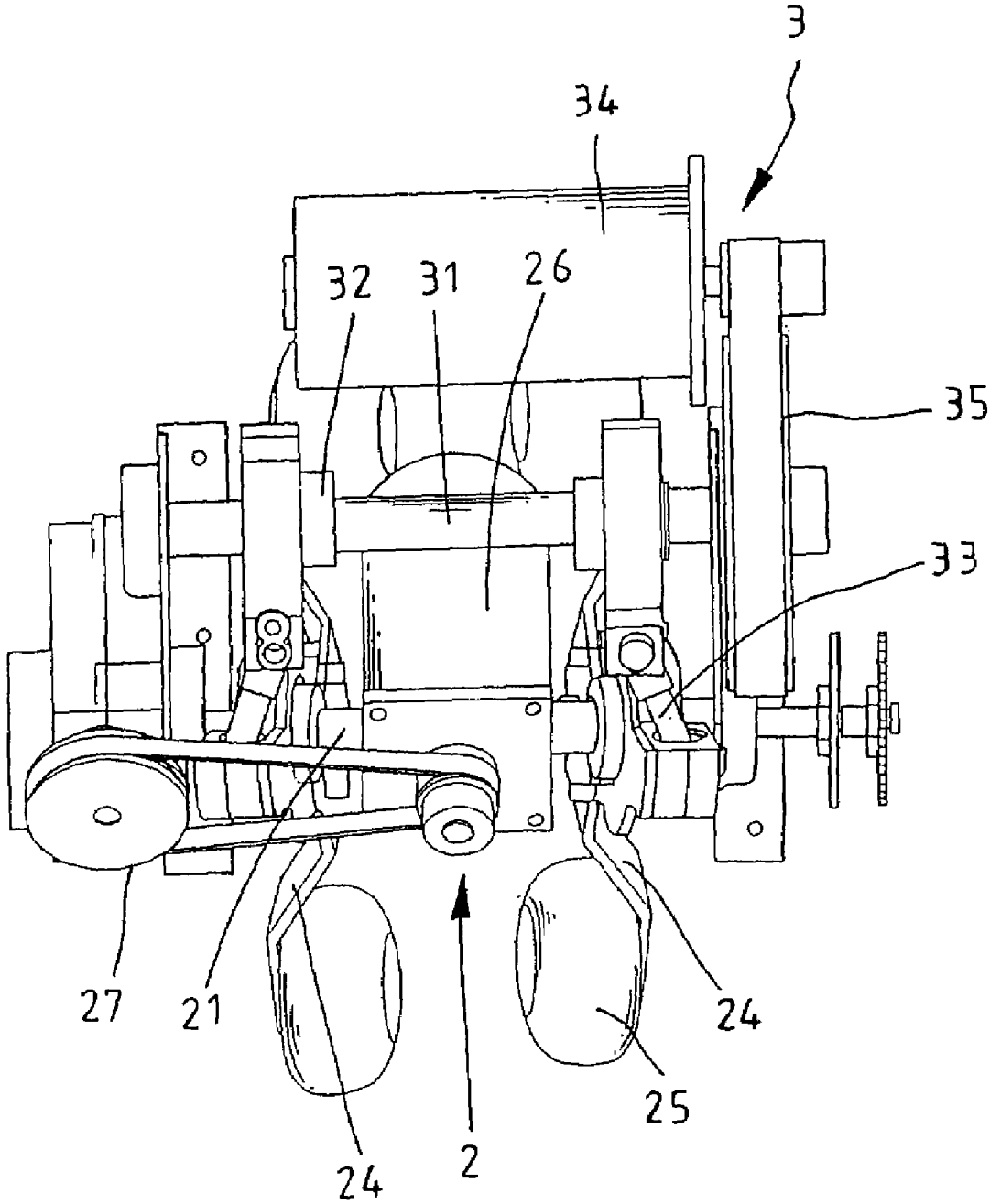
F I G . 6 PRIOR ART
FIG. 6 shows a schematic view of the pounding device of the prior art massaging mechanism.
Figure 8:
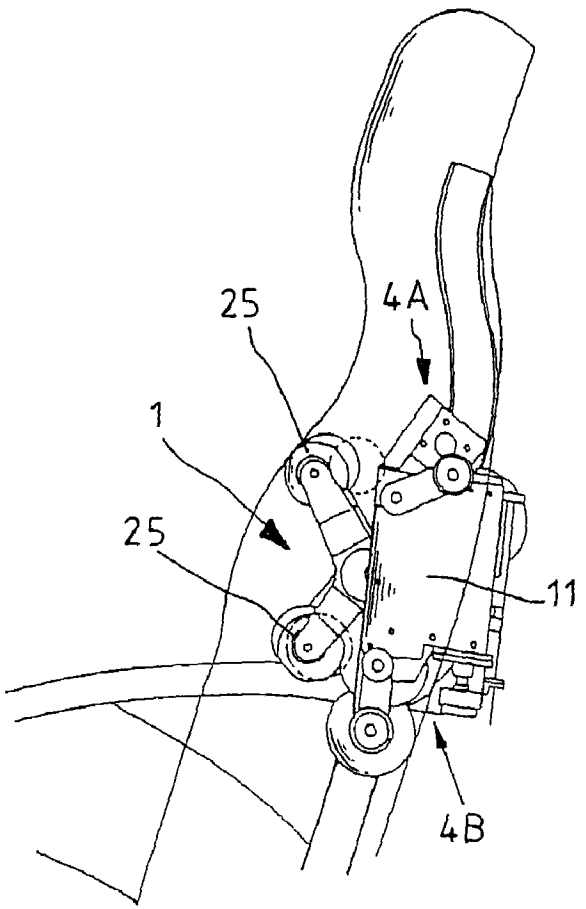
FIG. 8 PRIOR ART
FIG. 8 shows a schematic view of the angle-adjusting device of the prior art massaging mechanism.
Figure 7:
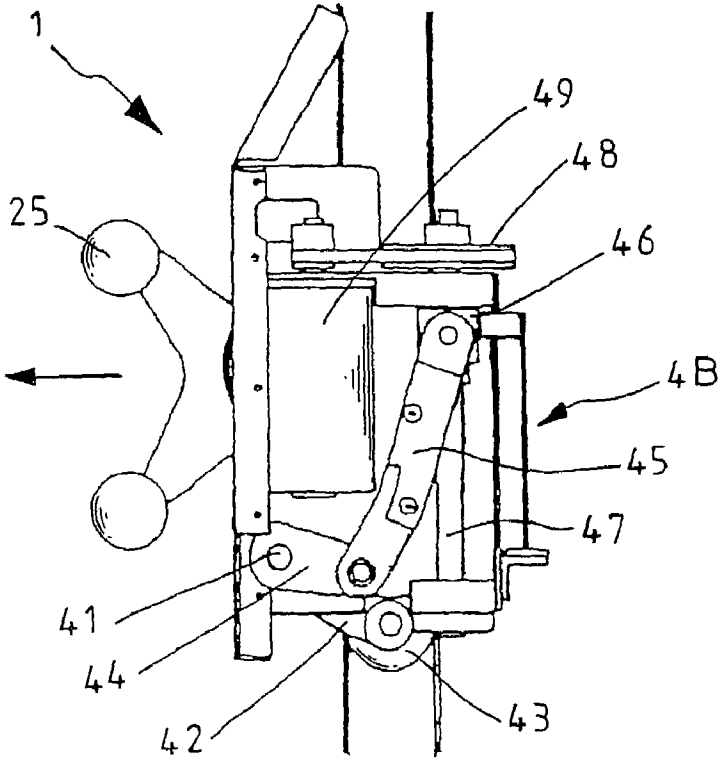
FIG. 7 PRIOR ART
FIG. 7 shows a schematic view of the displacement devices of the prior art massaging mechanism.
Figure 9:
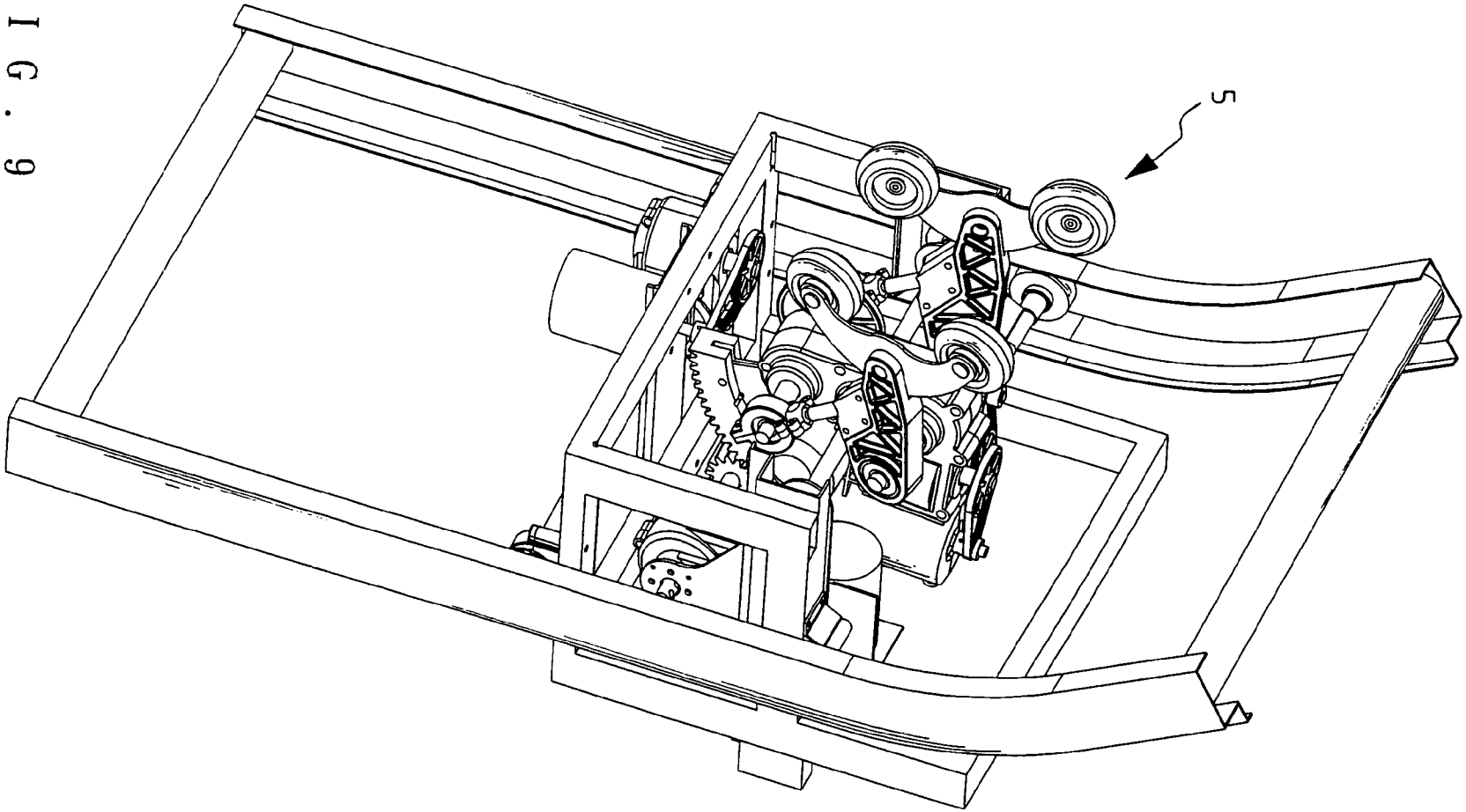
FIG. 9 shows a schematic view of the present invention mounted on the guide rails of a chair.

As shown in FIGS. 9–20, a massaging mechanism 5 embodied in the present invention is mounted on two guide rails of a chair in conjunction with a lifting device.

The massaging mechanism 5 of the present invention comprises a displacement device 6, a rubbing device 7, a pounding device 8, and an angle-adjusting device 9.

As shown in FIGS. 10, 11, 13, 14, and 15, the displacement device 6 comprises a motor 61 by which a belted wheel set 62 is driven to actuate a worm wheel set 63. The worm wheel set 63 has a worm wheel 631 which is mounted on a main displacement shaft 64 which is linked to a machine frame 51 by a transmission device comprising two gears 65 which are respectively mounted on both ends of the main displacement shaft 64. The machine frame 51 is provided with a rack 52. The main displacement shaft 64 is provided at two ends with a connection piece 66 for coupling an auxiliary displacement shaft 67. The main shaft 64 and the auxiliary shaft 67 are provided at two ends with a slide wheel 68, which is disposed in a slide slot 53 of the machine frame 51.

As shown in FIGS. 10, 13, 14, and 16, the rubbing device 7 comprises a cover 71 by which it is suspended on the auxiliary shaft 67 of the displacement device 6. The rubbing device 7 further comprises a motor 72 and a belted wheel set 73 driven by the motor 72. The belted wheel set 73 actuates a worm wheel set 74 comprising a worm wheel 741 which is mounted on a rubbing shaft 75. The rubbing shaft 75 is provided at both ends with a swing arm 76 which is in turn provided with two rubbing rollers 77, each being tilted.

As shown in FIGS. 10, 14, 16, and 17, the pounding device 8 comprises a motor 81 and a belted wheel set 82 driven by the motor 81. The belted wheel set 82 actuates a pounding shaft 83 which is put through the cover 71 of the rubbing device 7. The pounding shaft 83 has two ends, each being of an eccentric construction and having a seat 84 for disposing a connection rod 85 which is provided at one end with two planar surfaces and is capable of swiveling side way in the seat 84. The connection rod 85 is fastened at other end with the swing arm 76 of the rubbing device 7 by a universal joint.

Figure 10:
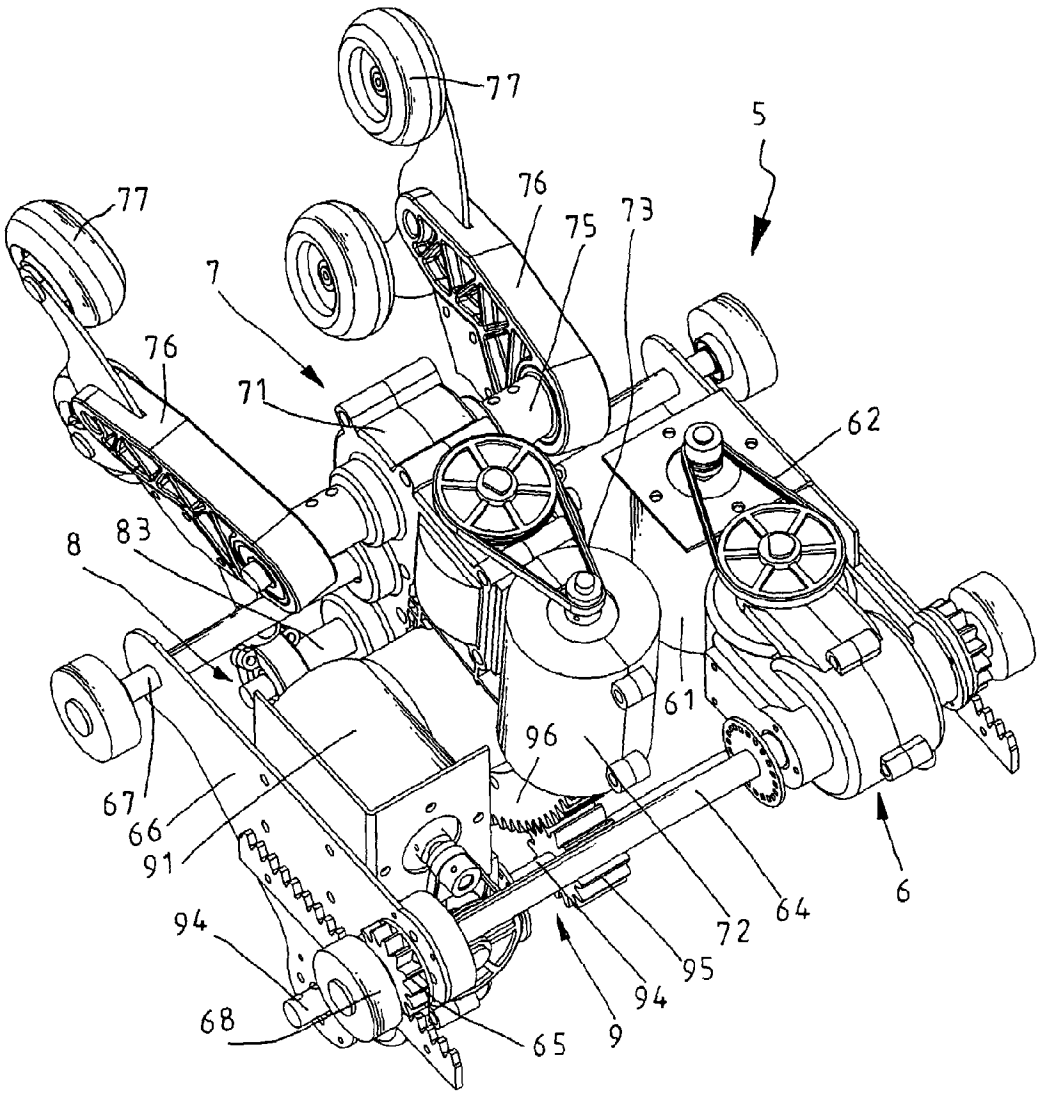
FIG. 10 shows a top view of the present invention.
Figure 11:
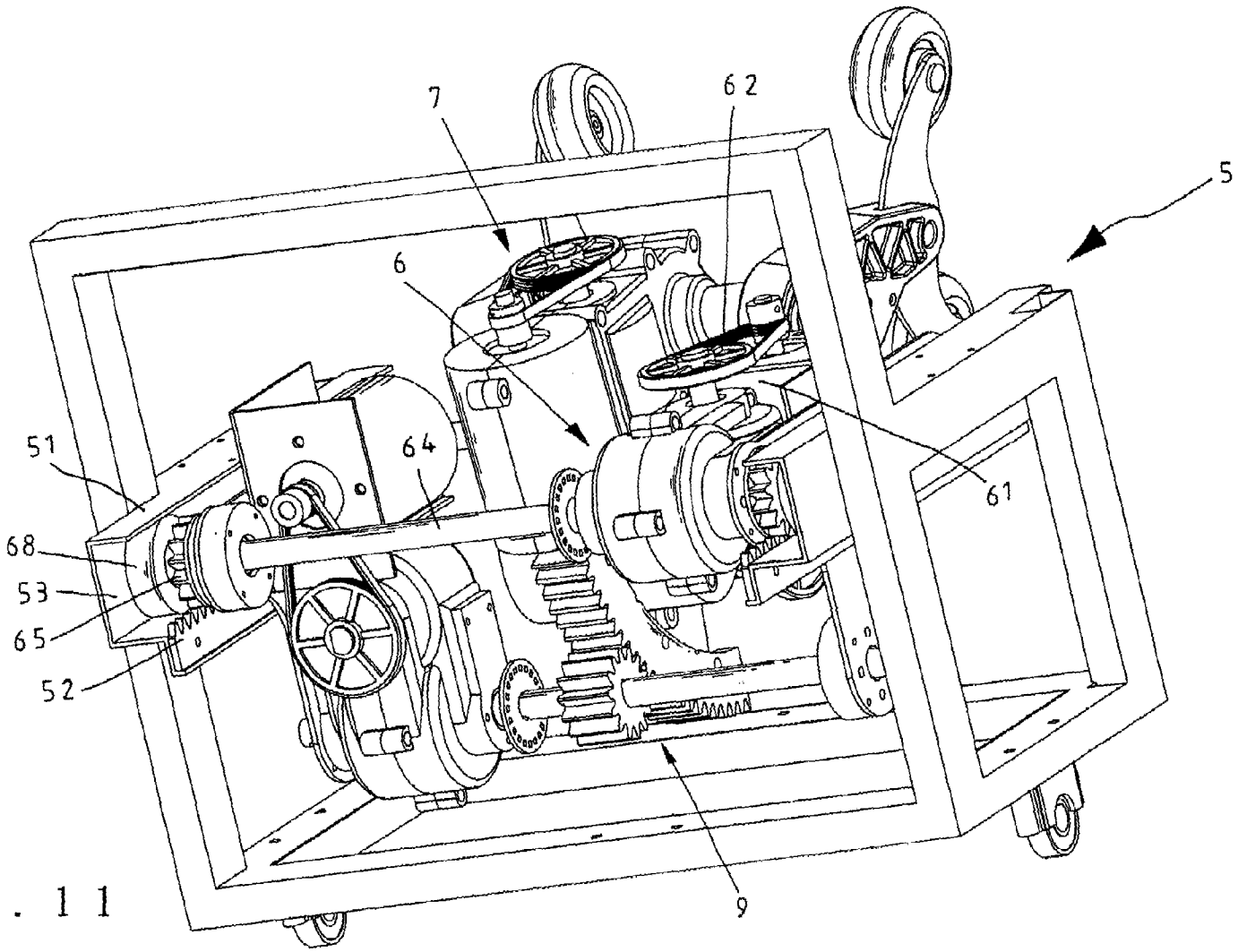
FIG. 11 shows a rear view of the present invention.
Figure 18:
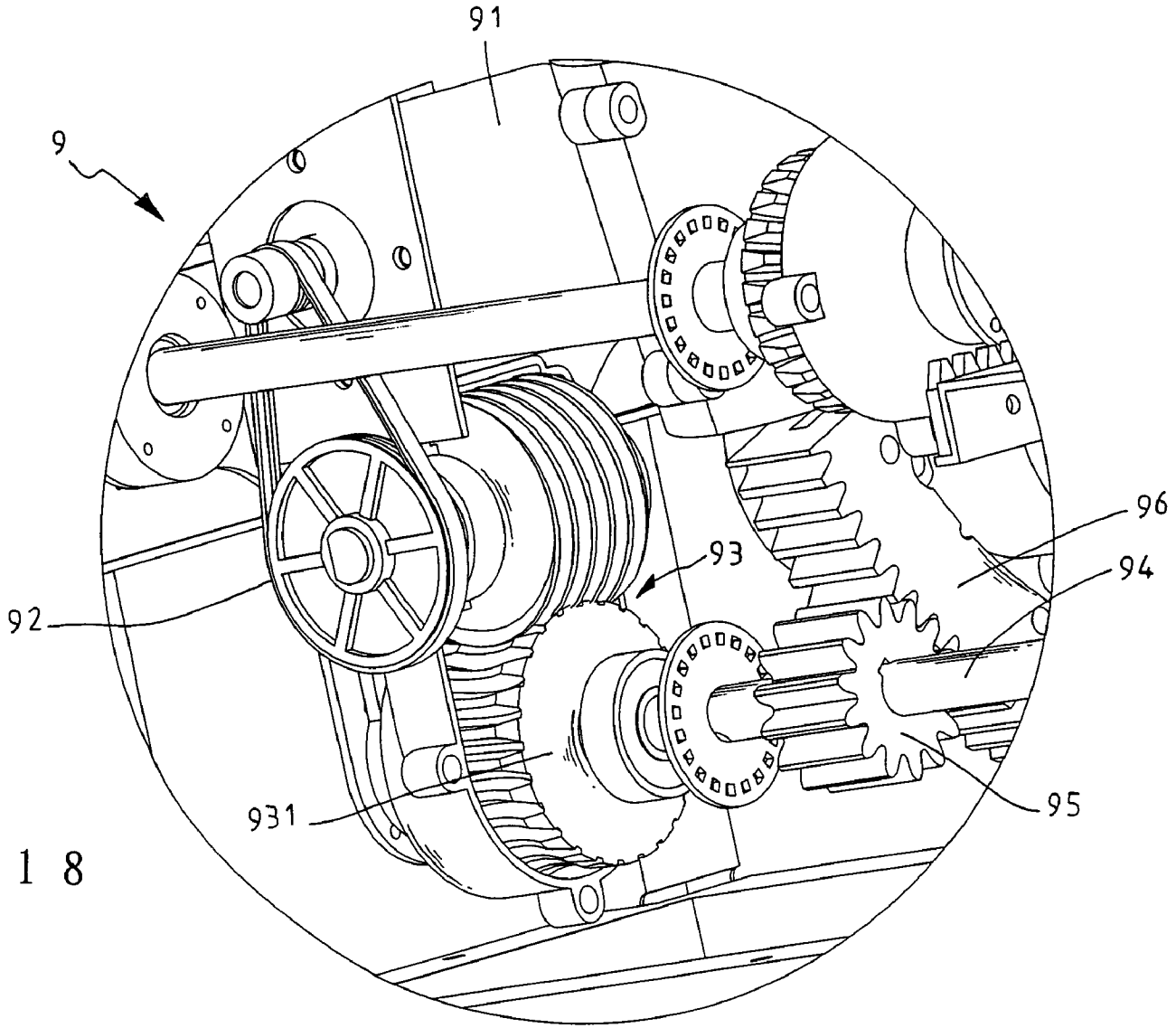
FIG. 18 shows a partial sectional view of the angle-adjusting device of the present invention.

As shown in FIGS. 10, 11, and 18, the angle-adjusting device 9 comprises a motor 91 which is mounted on the connection piece 66 of the displacement device 6 for driving a belted wheel set 92 which in turn actuates a worm wheel set 93 having a worm wheel 931. The worm wheel 931 is mounted on an angle adjusting shaft 94, which is in turn mounted on the connection piece 66 of the displacement device 6 and is provided with a gear 95 mounted thereon such that the gear 95 is engaged with an arcuate rack 96 fastened with the underside of the cover 71 of the rubbing device 7. The arcuate rack 96 may be of various designs, depending on the needs of a machine user.

Figure 13:
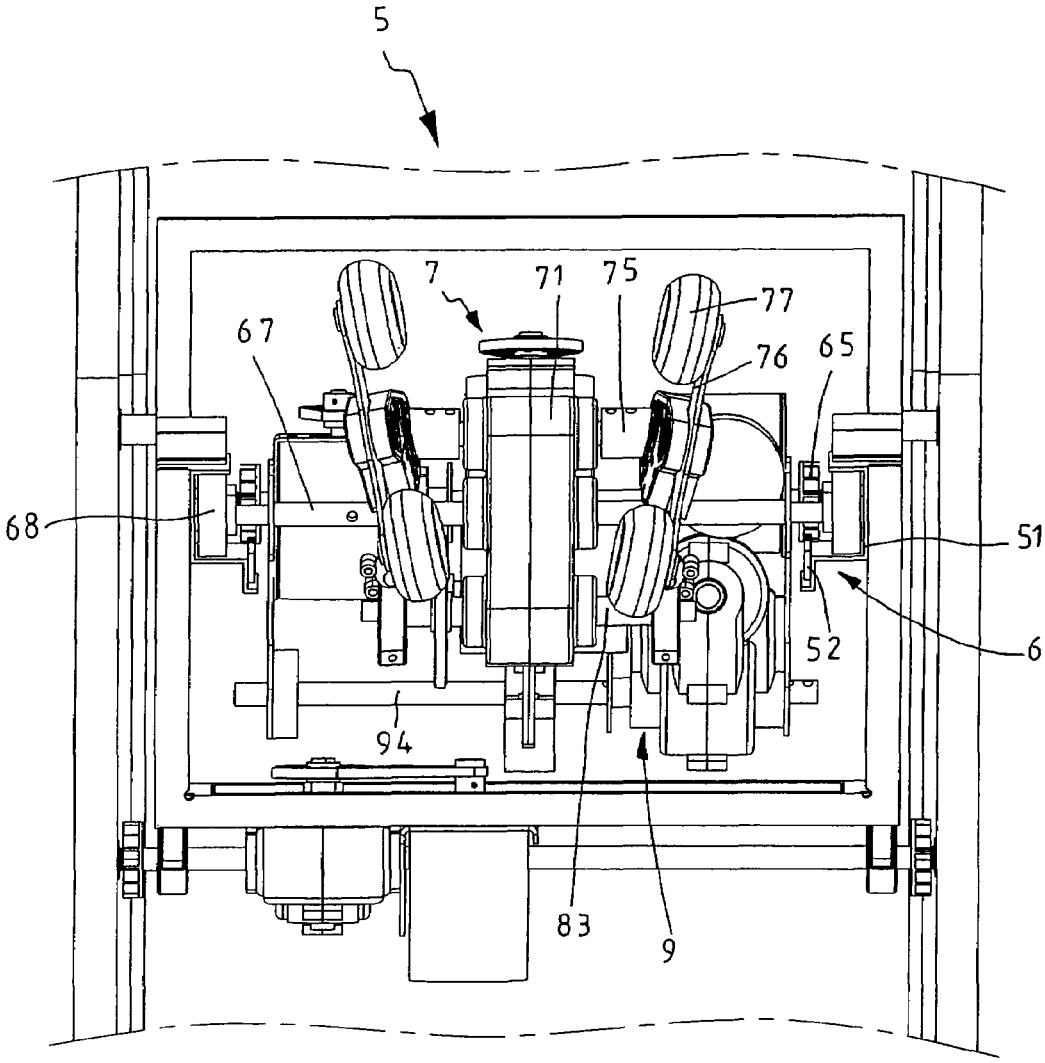
FIG. 13 shows a front view of the present invention.
Figure 16:
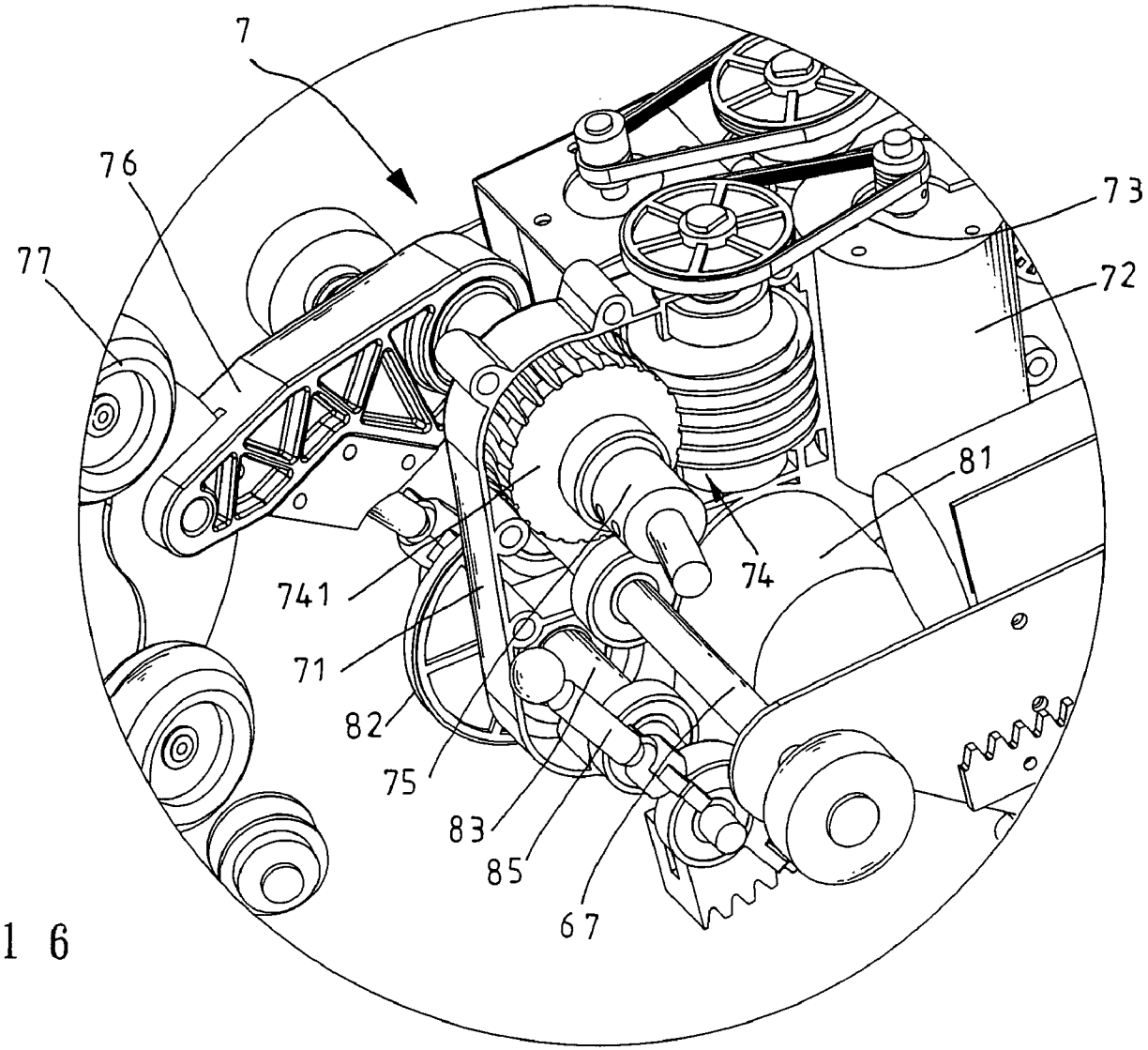
FIG. 16 shows a partial sectional view of the rubbing device of the present invention.

As illustrated in FIGS. 10, 13, and 16, the belted wheel set 73 of the rubbing device 7 is driven by the motor 72, so as to actuate the worm wheel set 74 which in turn actuates the rubbing shaft 75 to rotate. In light of the swing arms 76 of the rubbing shaft 75 being tilted inwards and connected with the connection rod 85 by a universal joint, the rubbing rollers 77 of the two swing arms 76 are capable of rubbing action at the time when the rubbing shaft 75 turns.

Figure 12:
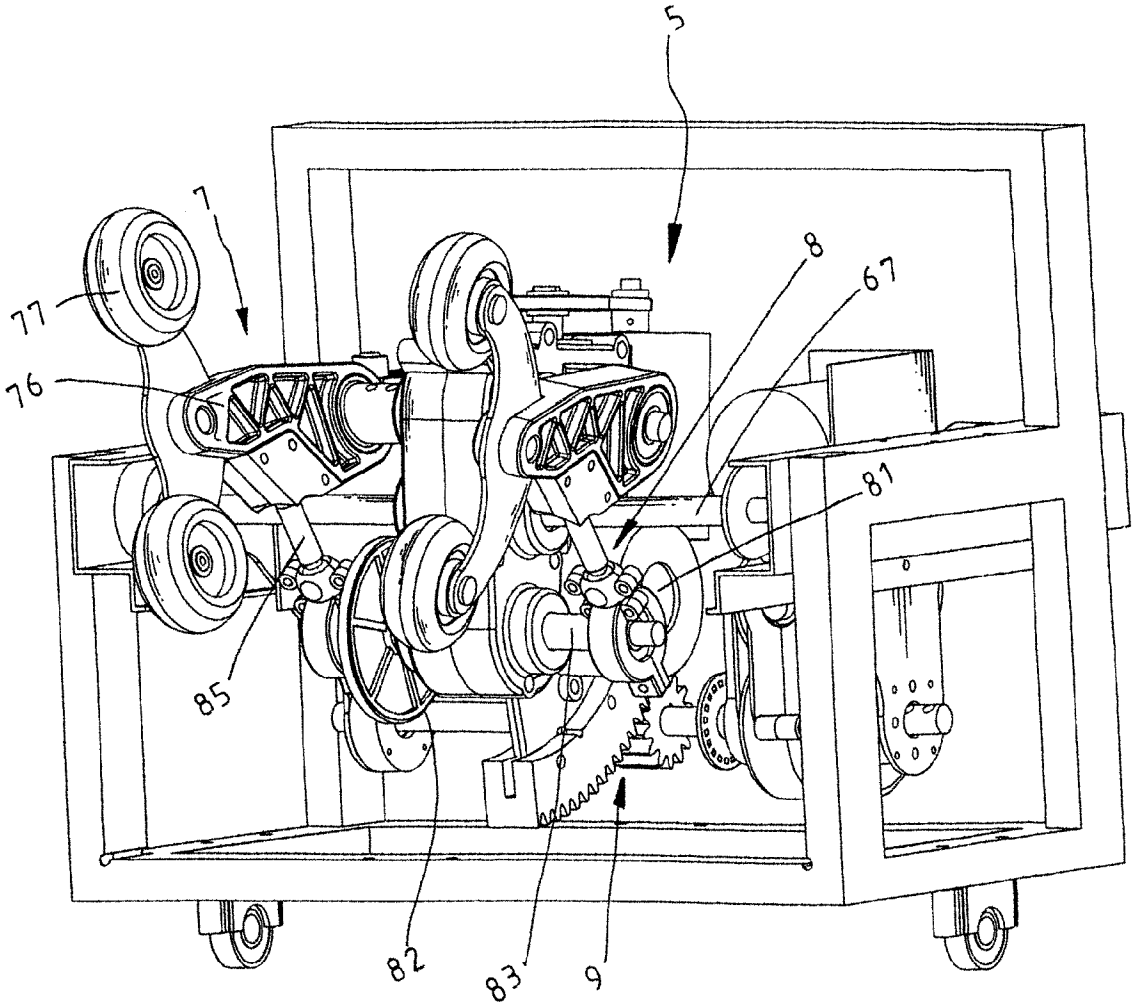
FIG. 12 shows a bottom view of the present invention.
Figure 14:
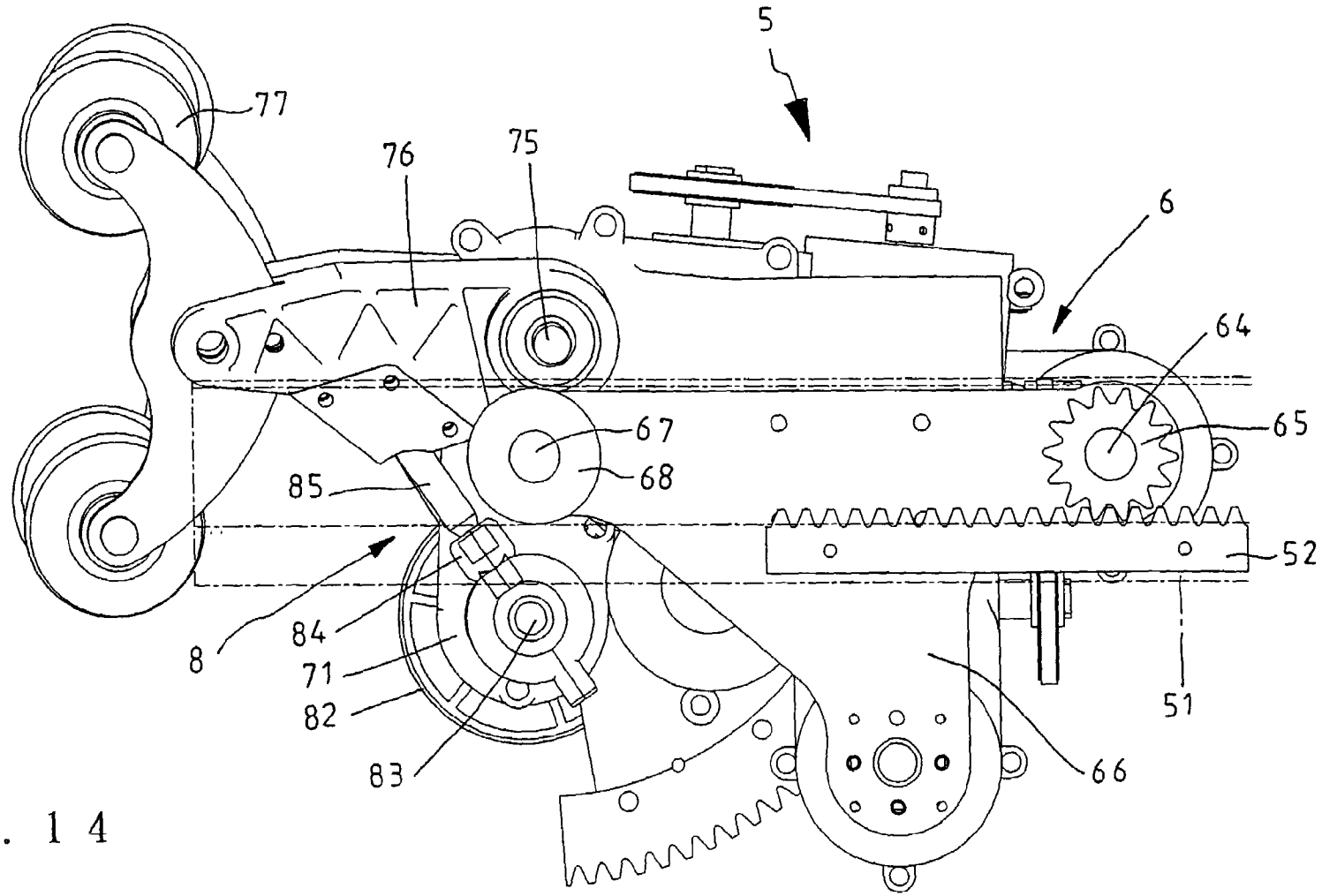
FIG. 14 shows a partial side view of the present invention.
Figure 17:
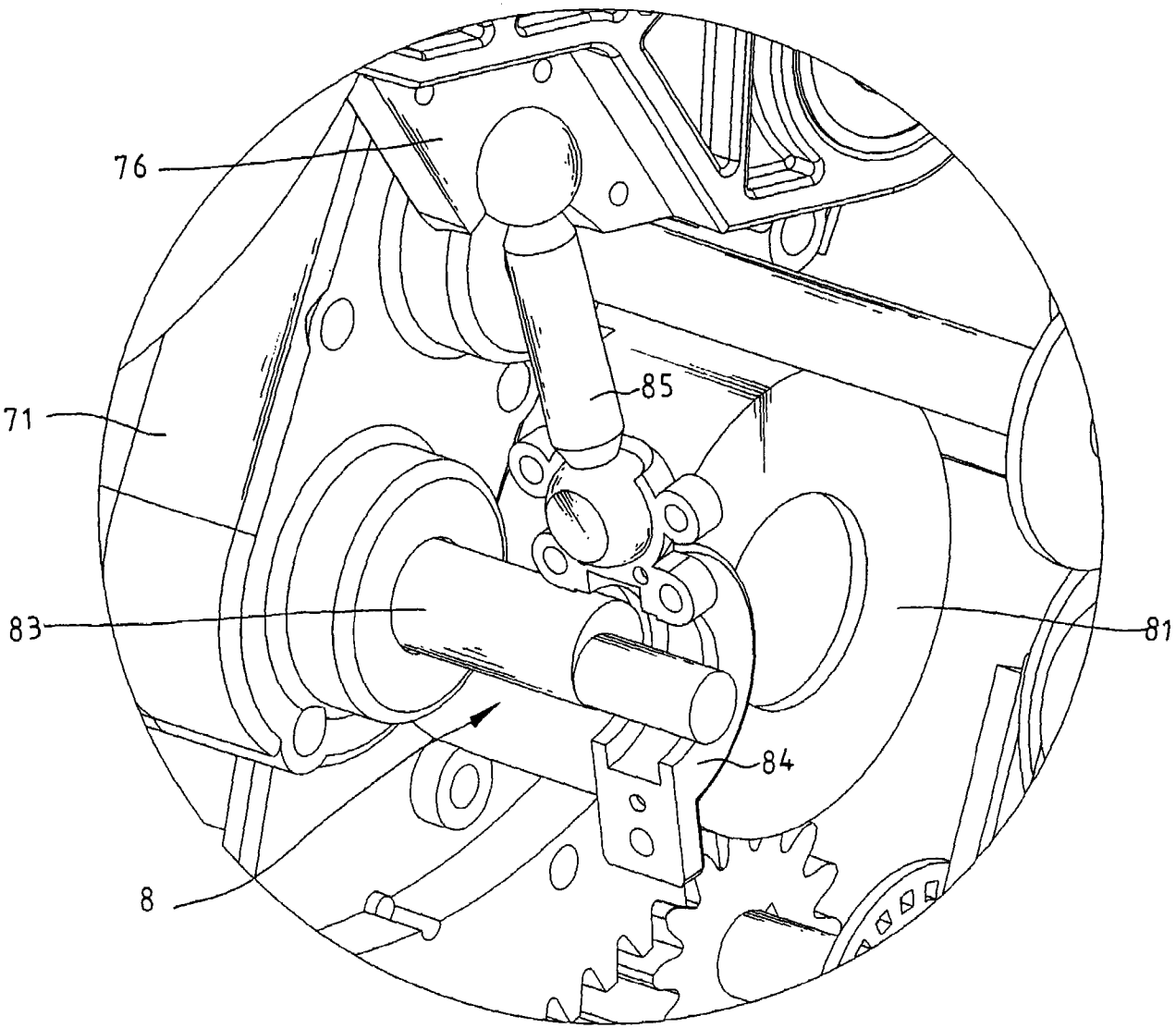
FIG. 17 shows a partial sectional view of the pounding device of the present invention.

As illustrated in FIGS. 12, 14, and 17, the belted wheel 82 of the pounding device 8 is driven by the motor 81, so as to actuate the pounding shaft 83 to turn. In light of both ends of the pounding shaft 83 being of an eccentric design, the connection rod 85 is capable of moving up and down on the seat 84 such that the connection rod 85 actuates the two swing arms 76 to engage in a swinging motion. As a result, the two rubbing rollers 77 are caused to swivel up and down to bring about a pounding action.

Figure 15:
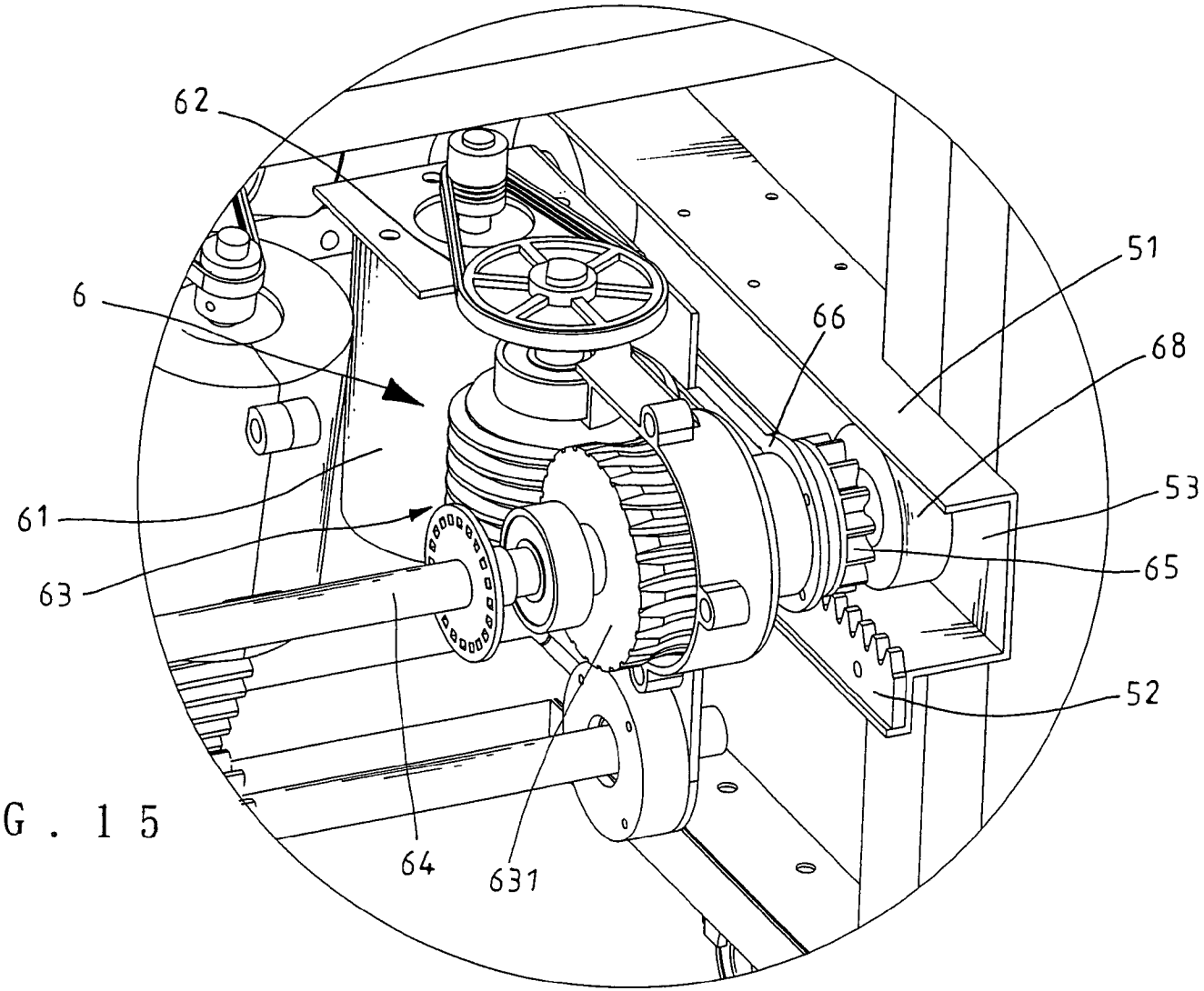
FIG. 15 shows a partial sectional view of the displacement device of the present invention.
Figure 19:
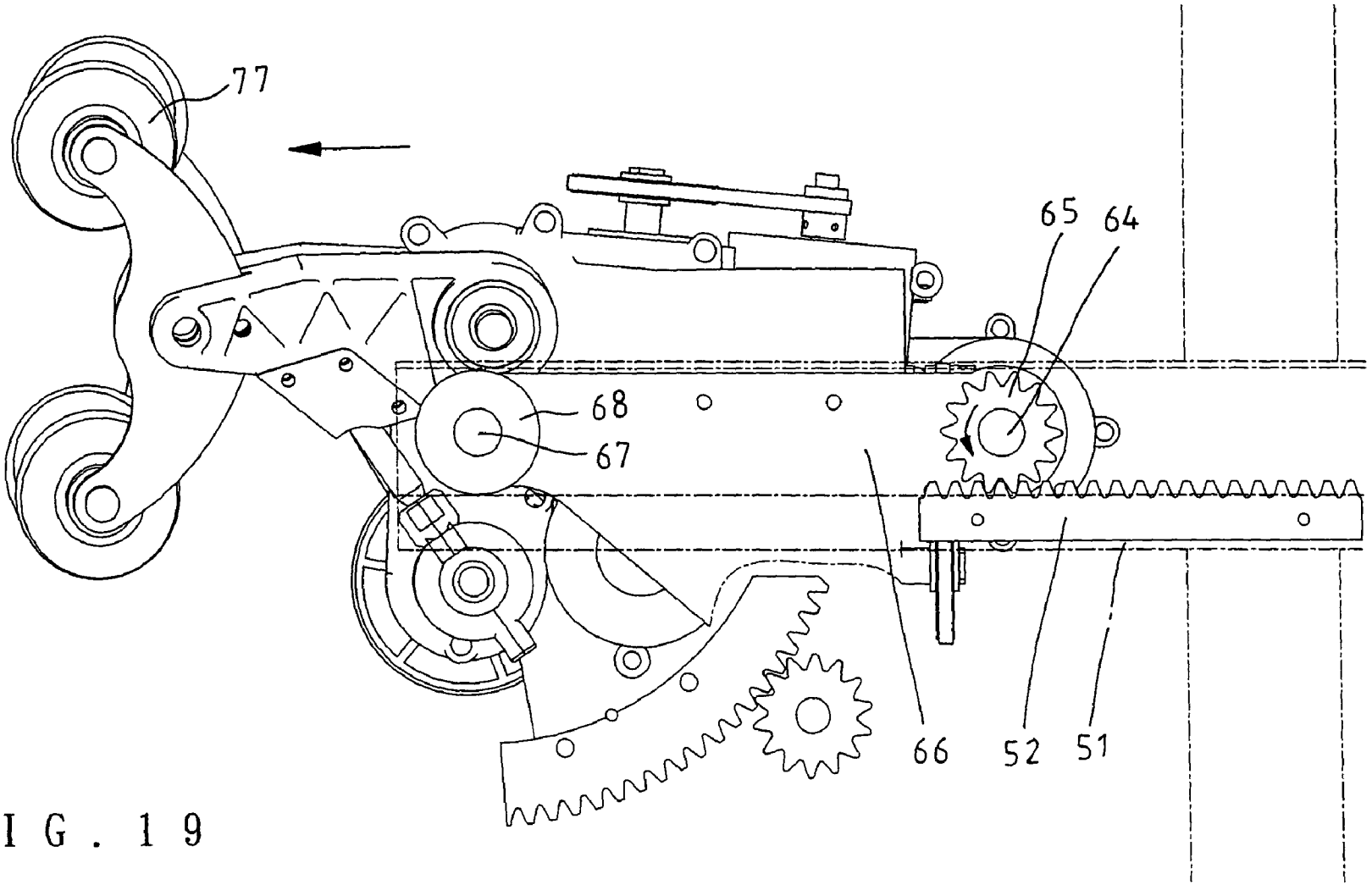
FIG. 19 shows a schematic view of the present invention at work.

As illustrated in FIGS. 14, 15, and 19, the belted wheel set 62 of the displacement device 6 is driven by the motor 61, so as to actuate the worm wheel set 63 which in turn actuates the main displacement shaft 64 to rotate. As a result, the tow gears 65, which are mounted on two ends of the main displacement shaft 64, move on the rack 52 of the machine frame 51. In the meantime, the auxiliary displacement shaft 67 is actuated by the connection piece 66 of the displacement device 6. As a result, the slide wheels 68 of both ends of the main shaft 64 and the auxiliary shaft 67 are caused to slide along the slide slots 53 of the machine frame 51, thereby resulting in a linear motion of the massaging mechanism 5.

By controlling the motor 61, the main displacement shaft 64 can be actuated to turn in reverse, so as to actuate the massaging mechanism 5 to displace backward. The massaging effect of the rubbing rollers 77 can be then adjusted. In light of the self-locking mechanism of the worm wheel set 63 of the displacement device 6, the gears 65 of the displacement device 6 are securely engaged with the rack 52 of the machine frame 51 at such time when the rubbing rollers 77 are exerted on by the pressure of the body of a person.

Figure 20:
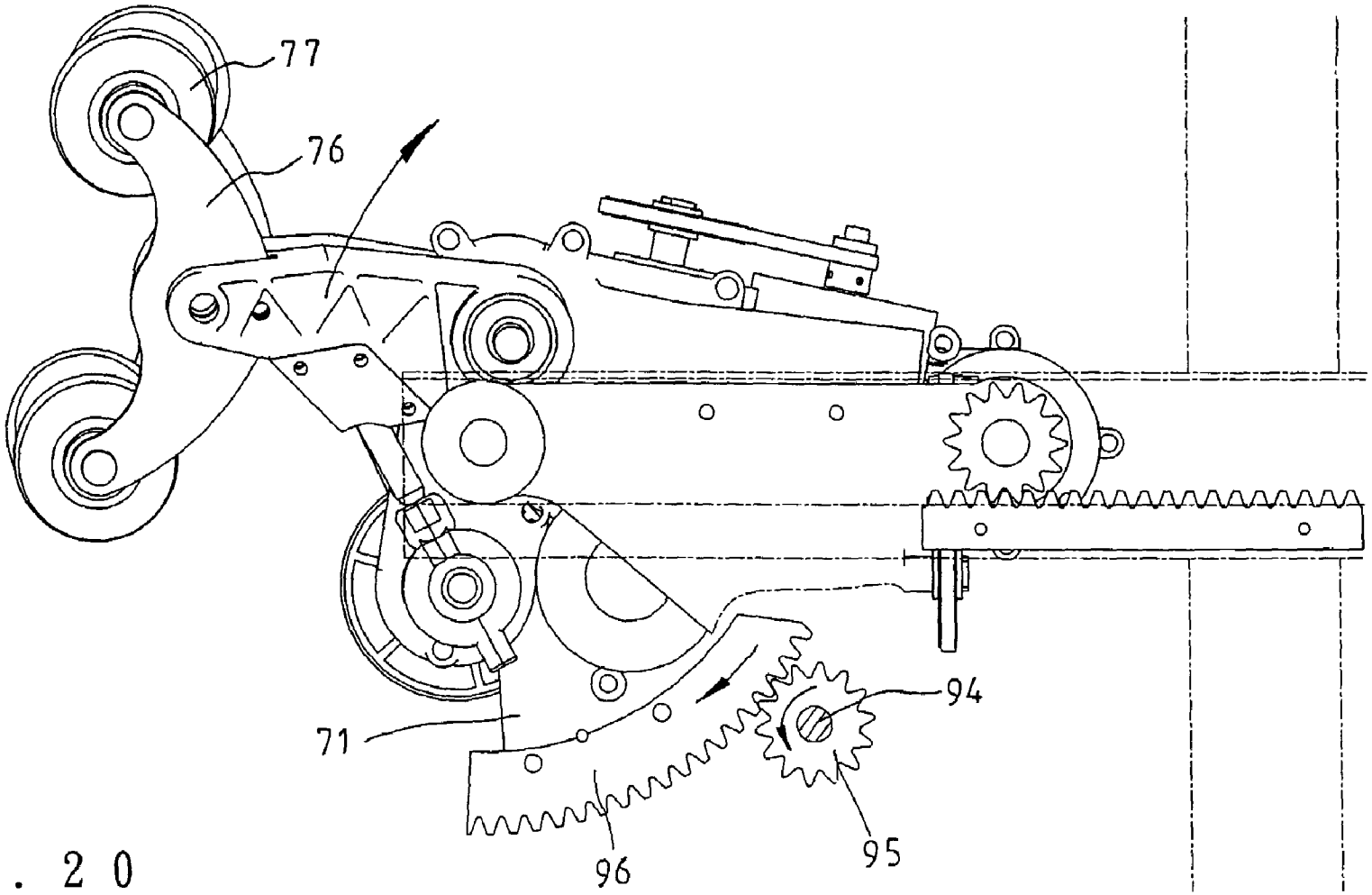
FIG. 20 shows a schematic view of the angle-adjusting device of the present invention in action.

As shown in FIGS. 14, 18, and 20, the belted wheel set 92 of the angle-adjusting device 9 is driven by the motor 91, so as to actuate the worm wheel set 93 which in turn actuates the angle-adjusting shaft 94 to turn, thereby resulting in engagement of the gear 95 with the arcuate rack 96. The inclination of the massaging mechanism 5 is thus adjusted such that the two swing arms 76 of the rubbing device 7 are tilted. The inclination of the massaging mechanism 5 is dependent on the curvature of the arcuate rack 96. As a result, the rubbing rollers 77 of the two swing arms 76 of the rubbing device 7 can be tilted as desired.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A massaging mechanism of a massaging machine, said mechanism comprising:

a displacement device comprising a main displacement shaft driven by a driving source and linked with a machine frame of the massaging machine by a transmission device, thereby enabling said massaging mechanism to engage in a linear motion on the machine frame;

a rubbing device mounted on said displacement device and provided with a rubbing shaft whereby said rubbing shaft is provided with a plurality of rubbing rollers mounted thereon, said rubbing shaft being driven by a driving source so as actuate said rubbing rollers to affect a rubbing action;

a pounding device mounted on said displacement device and provided with a pounding shaft whereby said pounding shaft is driven by a driving source to actuate said rubbing rollers to engage in a pounding action;

an angle-adjusting device mounted on said displacement device and provided with an angle-adjusting shaft whereby said angle-adjusting shaft is driven by a driving source, said driving source of said angle-adjusting device is a motor, wherein said angle-adjusting shaft is actuated by a worm wheel set which is in turn actuated by a belted wheel set whereby said belted wheel set is driven by said motor; and wherein said angle-adjusting shaft is provided with a gear mounted thereon whereby said gear is engaged with an arcuate rack, so as to adjust the angular position of said rubbing rollers with respect to said machine frame.

2. The massaging mechanism as defined in claim 1, wherein said main displacement shaft of said displacement device is actuated by a worm wheel set which is in turn actuated by a belted wheel set; wherein said driving source of said displacement device is a motor which drives said belted wheel set.

3. The massaging mechanism as defined in claim 2, wherein said displacement shaft is provided at two ends with a gear whereby said gear is engaged with a rack of the machine frame.

4. The massaging mechanism as defined in claim 2, wherein said displacement device comprises said main displacement shaft and an auxiliary shaft connected with said main displacement shaft by a connection piece whereby said main displacement shaft and said auxiliary shaft are provided at two ends thereof with a slide wheel capable of sliding along a slide slot of the machine frame.

5. The massaging mechanism as defined in claim 4, wherein said rubbing shaft and said pounding shaft are put through a cover whereby said cover is suspended on said auxiliary shaft of said displacement device.

6. The massaging mechanism as defined in claim 1, wherein said driving source of said rubbing device is a motor; wherein said rubbing shaft is actuated by a worm wheel set which is in turn actuated by a belted wheel set whereby said belted wheel set is driven by said motor.

7. The massaging mechanism as defined in claim 6, wherein said rubbing shaft has two ends, each being slanted for fastening a swing arm on which said rubbing rollers are mounted.

8. The massaging mechanism as defined in claim 1, wherein said driving source of said pounding device is a motor; wherein said pounding shaft is actuated by a belted wheel set which is driven by said motor.

9. The massaging mechanism as defined in claim 7, wherein said pounding shaft is provided at two ends with a seat, and a connection rod mounted on said seat such that said connection rod is connected to said swing arm of said rubbing device.

10. The massaging mechanism as defined in claim 1, wherein said angle-adjusting shaft is mounted on a connection member of said displacement device.

* * * * *